US009765996B2

(12) United States Patent
Matsui

(10) Patent No.: US 9,765,996 B2
(45) Date of Patent: Sep. 19, 2017

(54) REGENERATIVE REFRIGERATOR

(71) Applicant: Sumitomo Heavy Industries, Ltd., Tokyo (JP)

(72) Inventor: Takaaki Matsui, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 189 days.

(21) Appl. No.: 14/638,688

(22) Filed: Mar. 4, 2015

(65) Prior Publication Data

US 2015/0253042 A1 Sep. 10, 2015

(30) Foreign Application Priority Data

Mar. 5, 2014 (JP) ..... 2014-042337

(51) Int. Cl.
*F25B 9/06* (2006.01)
*F25B 9/10* (2006.01)
*F25B 9/14* (2006.01)

(52) U.S. Cl.
CPC ..... *F25B 9/145* (2013.01); *F25B 9/10* (2013.01); *F25B 9/14* (2013.01)

(58) Field of Classification Search
CPC ..... F25B 9/06; F25B 9/10; F25B 9/14; F25B 2309/003; F25B 2309/1401; F25B 2309/1414; F25B 2309/1415
See application file for complete search history.

(56) References Cited

U.S. PATENT DOCUMENTS 5,447,034 A * 9/1995 Kuriyama ..... F16J 9/062 148/301
5,787,712 A 8/1998 Fukui et al.
2010/0229572 A1* 9/2010 Raiju ..... F25B 9/14 62/6
2013/0086926 A1 4/2013 Xu
2013/0327065 A1 12/2013 Xu et al.

FOREIGN PATENT DOCUMENTS

| | | | |
|---|---|---|---|
| CN | 103486756 | A | 1/2014 |
| JP | H04-068268 | A | 3/1992 |
| JP | H05-018622 | A | 1/1993 |
| JP | 3390612 | B2 | 3/2003 |
| TW | 201337191 | A | 9/2013 |

OTHER PUBLICATIONS

Office Action issued in Taiwan Application No. 104106306, dated Mar. 28, 2016.
Office Action issued in Korean Application No. 10-2015-0029072, dated Jan. 18, 2016.

* cited by examiner

*Primary Examiner* — Ryan J Walters
*Assistant Examiner* — Erik Mendoza-Wilkenfe
(74) *Attorney, Agent, or Firm* — Michael Best & Friedrich LLP

(57) ABSTRACT

A regenerative refrigerator of a single stage type or a multistage type includes: a cylinder having a cooling stage and a cylinder side wall axially extending from the cooling stage; a displacer having a regenerator provided at the same stage as the cooling stage and a displacer side wall axially extending to face the cylinder side wall, and axially movably disposed in the cylinder; and a low temperature-side gas flow path making a gas expansion space between the displacer and the cooling stage communicate with a low-temperature end of the regenerator and having a gas flow gap between the displacer side wall and the cylinder side wall, and a displacer gas passage making the gas flow gap communicate with the low-temperature end of the regenerator and having a gap-side opening provided further toward a high temperature side than the low-temperature end of the regenerator.

6 Claims, 5 Drawing Sheets

REGENERATIVE REFRIGERATOR

RELATED APPLICATIONS

Priority is claimed to Japanese Patent Application No. 2014-042337, filed Mar. 5, 2014, the entire content of which is incorporated herein by reference.

BACKGROUND

Technical Field

Certain embodiments of the invention relate to a regenerative refrigerator.

Description of Related Art

A regenerative refrigerator is used in order to cool an object to be cooled from about 100 K (kelvin) to about 4 K, for example. As regenerative refrigerators, there are, for example, a Gifford McMahon type (GM) refrigerator, a pulse tube refrigerator, a Stirling refrigerator, a Solvay refrigerator, and the like. The regenerative refrigerator is used for cooling of a superconducting magnet, a detector, or the like, or as a cryopump.

SUMMARY

According to an embodiment of the present invention, there is provided a regenerative refrigerator of a single stage type or a multistage type including: a cylinder which is provided with a cooling stage; a displacer which is provided with a regenerator provided at the same stage as the cooling stage and disposed so as to be able to move in an axial direction in the cylinder; and a low temperature-side gas flow path which makes a gas expansion space between the displacer and the cooling stage communicate with a low-temperature end of the regenerator. The cylinder is provided with a cylinder side wall extending in the axial direction from the cooling stage to a high temperature side. The displacer is provided with a displacer side wall extending to face the cylinder side wall in the axial direction. The low temperature-side gas flow path is provided with a gas flow gap defined by an outer peripheral surface of the displacer side wall and an inner peripheral surface of the cylinder side wall, and a displacer gas passage which makes the gas flow gap communicate with the low-temperature end of the regenerator. The gas flow gap is continuous to the gas expansion space on a low temperature side in the axial direction. The displacer gas passage has a gap-side opening leading to the gas flow gap in the outer peripheral surface of the displacer side wall. A position of the gap-side opening in the axial direction is further toward the high temperature side than a position of the low-temperature end of the regenerator in the axial direction.

DETAILED DESCRIPTION

Figure 1:
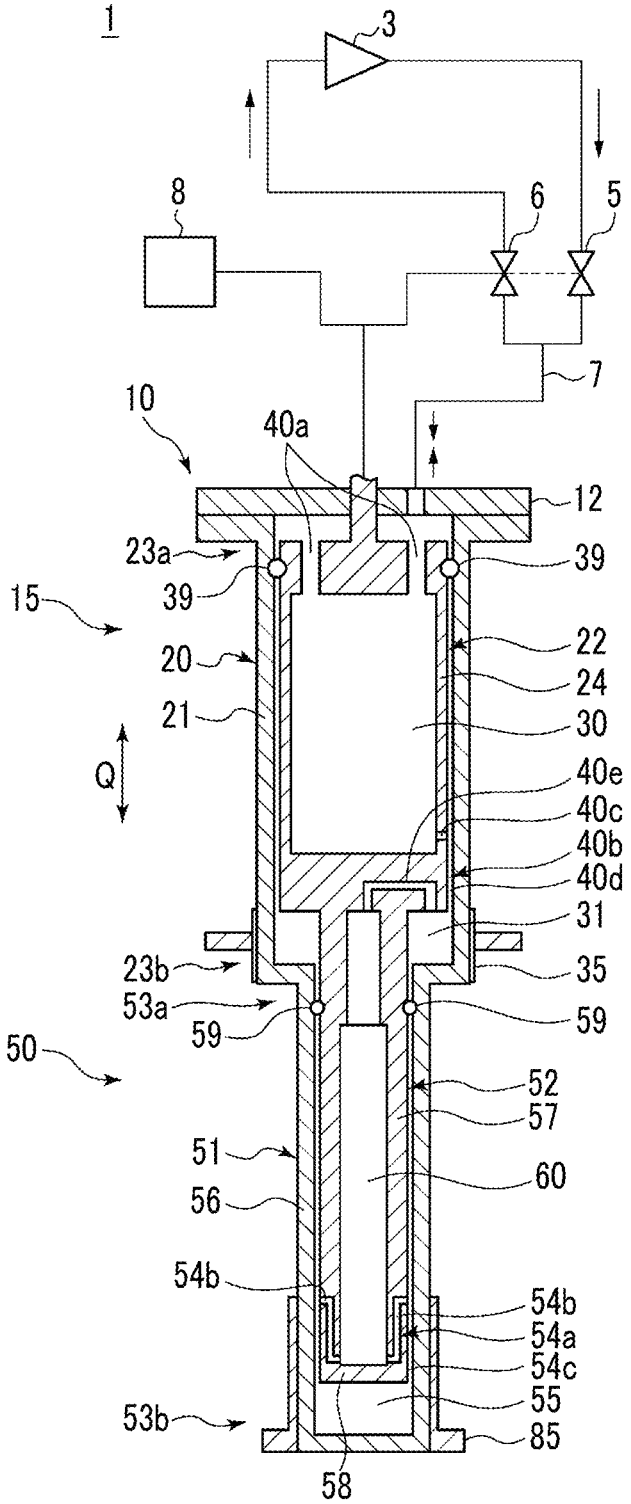
FIG. 1 is a diagram schematically showing a regenerative refrigerator according to a certain embodiment of the present invention.

It is desirable to realize a reduction in the size of a regenerative refrigerator and/or improvement in refrigeration capacity.

Hereinafter, certain embodiments of the present invention will be described in detail with reference to the drawings. In addition, in the description, the same elements are denoted by the same reference numerals and repeated description is appropriately omitted. Further, configurations described below are illustrative and do not limit the scope of the present invention.

FIG. 1 is a diagram schematically showing a regenerative refrigerator according to a certain embodiment of the present invention. A regenerative refrigerator such as a GM refrigerator 1 is provided with a regenerator section, an expander, and a compressor. In most cases, the regenerator section is provided at the expander. The regenerator section is configured so as to pre-cool working gas (for example, helium gas). The expander is provided with a space for expanding the pre-cooled working gas in order to further cool the working gas pre-cooled by the regenerator section. The regenerator section is configured so as to be cooled by the working gas cooled by expansion. The compressor is configured so as to recover the working gas from the regenerator section, compress the working gas, and then supply the working gas to the regenerator section again.

In a two-stage type refrigerator such as the GM refrigerator 1 shown in the drawings, the regenerator section is provided with a first stage regenerator and a second stage regenerator. The first stage regenerator is configured so as to pre-cool the working gas which is supplied from the compressor to a low-temperature end temperature of the first stage regenerator. The second stage regenerator is configured so as to pre-cool the working gas pre-cooled by the first stage regenerator to a low-temperature end temperature of the second stage regenerator.

The GM refrigerator 1 has a gas compressor 3 which functions as a compressor, and a two-stage type cold head 10 which functions as an expander. The cold head 10 has a first stage cooling section 15 and a second stage cooling section 50, and these cooling sections are coaxially connected to a flange 12. The first stage cooling section 15 is provided with a first stage high-temperature end 23*a* and a first stage low-temperature end 23*b*, and the second stage cooling section 50 is provided with a second stage high-temperature end 53*a* and a second stage low-temperature end 53*b*. The first stage cooling section 15 is connected in series to the second stage cooling section 50. Accordingly, the first stage low-temperature end 23*b* adjoins the second stage high-temperature end 53*a*.

The first stage cooling section 15 is provided with a first stage cylinder 20, a first stage displacer 22, a first stage regenerator 30, a first stage expansion chamber 31, and a first stage cooling stage 35. The first stage cylinder 20 is a hollow airtight container. The first stage displacer 22 is provided in the first stage cylinder 20 so as to be able to reciprocate in an axial direction Q. The first stage regenerator 30 is provided with a first stage regenerative material filled into the first stage displacer 22. Accordingly, the first stage displacer 22 is a container which accommodates the first stage regenerative material. The first stage expansion chamber 31 is formed in the first stage cylinder 20 at the first stage low-temperature end 23*b*. The first stage expansion chamber 31 changes in volume according to the reciprocating motion of the first stage displacer 22. The first stage cooling stage 35 is mounted outside the first stage cylinder 20 at the first stage low-temperature end 23*b*.

The first stage cylinder 20 is provided with a first stage cylinder side wall 21 extending along the axial direction Q from the first stage cooling stage 35 to the high temperature side. The first stage displacer 22 is provided with a first stage displacer side wall 24 extending to face the first stage cylinder side wall 21 along the axial direction Q.

In the first stage high-temperature end 23*a*, a plurality of first stage high temperature-side gas passages 40*a* are provided in order to cause helium gas to flow into and out from the first stage regenerator 30. In the first stage low-temperature end 23*b*, a first stage low temperature-side gas flow path 40*b* is provided in order to cause the helium gas to flow back and forth between the first stage regenerator 30 and the first stage expansion chamber 31. The first stage low temperature-side gas flow path 40*b* makes the first stage expansion chamber 31 and a low-temperature end of the first stage regenerator 30 communicate with each other.

The first stage low temperature-side gas flow path 40*b* is provided with a first stage displacer gas passage 40*c* and a first stage gas flow gap 40*d*. The first stage displacer gas passage 40*c* makes the first stage gas flow gap 40*d* and the low-temperature end of the first stage regenerator 30 communicate with each other. The first stage displacer gas passage 40*c* has a gap-side opening leading to the first stage gas flow gap 40*d*, a regenerator-side opening leading to the low-temperature end of the first stage regenerator 30, and a connection path connecting the gap-side opening and the regenerator-side opening.

The first stage gas flow gap 40*d* is defined by the outer peripheral surface of the first stage displacer side wall 24 and the inner peripheral surface of the first stage cylinder side wall 21. The first stage gas flow gap 40*d* is continuous to the first stage expansion chamber 31 on the low temperature side in the axial direction Q. On the other hand, on the high temperature side of the first stage gas flow gap 40*d* in the axial direction Q, a first stage seal 39 which blockades gas flow between the first stage gas flow gap 40*d* and the first stage high-temperature end 23*a* is provided. The first stage seal 39 is disposed between the first stage cylinder 20 and the first stage displacer 22. Therefore, the flow of the working gas between the first stage high-temperature end 23*a* and the first stage low-temperature end 23*b* goes through the first stage regenerator 30.

The second stage cooling section 50 is provided with a second stage cylinder 51, a second stage displacer 52, a second stage regenerator 60, a second stage expansion chamber 55, and a second stage cooling stage 85. The second stage cylinder 51 is a hollow airtight container. The second stage displacer 52 is provided in the second stage cylinder 51 so as to be able to reciprocate in the axial direction Q along with the first stage displacer 22. The second stage regenerator 60 is provided with a second stage regenerative material filled into the second stage displacer 52. Accordingly, the second stage displacer 52 is a container which accommodates the second stage regenerative material. The second stage expansion chamber 55 is provided in the second stage cylinder 51 at the second stage low-temperature end 53*b*. The second stage expansion chamber 55 changes in volume according to the reciprocating motion of the second stage displacer 52. The second stage cooling stage 85 is mounted outside the second stage cylinder 51 at the second stage low-temperature end 53*b*.

The second stage cylinder 51 is provided with a second stage cylinder side wall 56 extending along the axial direction Q from the second stage cooling stage 85 to the high temperature side. The second stage displacer 52 is provided with a second stage displacer side wall 57 extending to face the second stage cylinder side wall 56 along the axial direction Q. A low-temperature end of the second stage displacer side wall 57 is blocked by a second stage displacer bottom portion 58.

In the second stage high-temperature end 53*a*, a second stage high temperature-side gas passage 40*e* is provided in order to cause the helium gas to flow into and out from the second stage regenerator 60. In the GM refrigerator 1 shown in the drawings, the second stage high temperature-side gas passage 40*e* connects the first stage expansion chamber 31 to the second stage regenerator 60. In the second stage low-temperature end 53*b*, a second stage low temperature-side gas flow path 54*a* is provided in order to cause the helium gas to flow into and out from the second stage expansion chamber 55. The second stage low temperature-side gas flow path 54*a* makes the second stage expansion chamber 55 and a low-temperature end of the second stage regenerator 60 communicate with each other.

The second stage low temperature-side gas flow path 54*a* is provided with a second stage displacer gas passage 54*b* and a second stage gas flow gap 54*c*. The second stage displacer gas passage 54*b* makes the second stage gas flow gap 54*c* and the low-temperature end of the second stage regenerator 60 communicate with each other.

The second stage gas flow gap 54*c* is defined by the outer peripheral surface of the second stage displacer side wall 57 and the inner peripheral surface of the second stage cylinder side wall 56. The second stage gas flow gap 54*c* is continuous to the second stage expansion chamber 55 on the low temperature side in the axial direction Q. On the other hand, on the high temperature side of the second stage gas flow gap 54*c* in the axial direction Q, a second stage seal 59 which blockades gas flow between the second stage gas flow gap 54*c* and the second stage high-temperature end 53*a* is provided. The second stage seal 59 is disposed between the second stage cylinder 51 and the second stage displacer 52. Therefore, the flow of the working gas between the second stage high-temperature end 53*a* and the second stage low-temperature end 53*b* goes through the second stage regenerator 60. In addition, the second stage cooling section 50 may be configured such that some gas flows between the second stage high-temperature end 53*a* and the second stage low-temperature end 53*b* through the second stage gas flow gap 54*c* is allowed.

Figure 2:
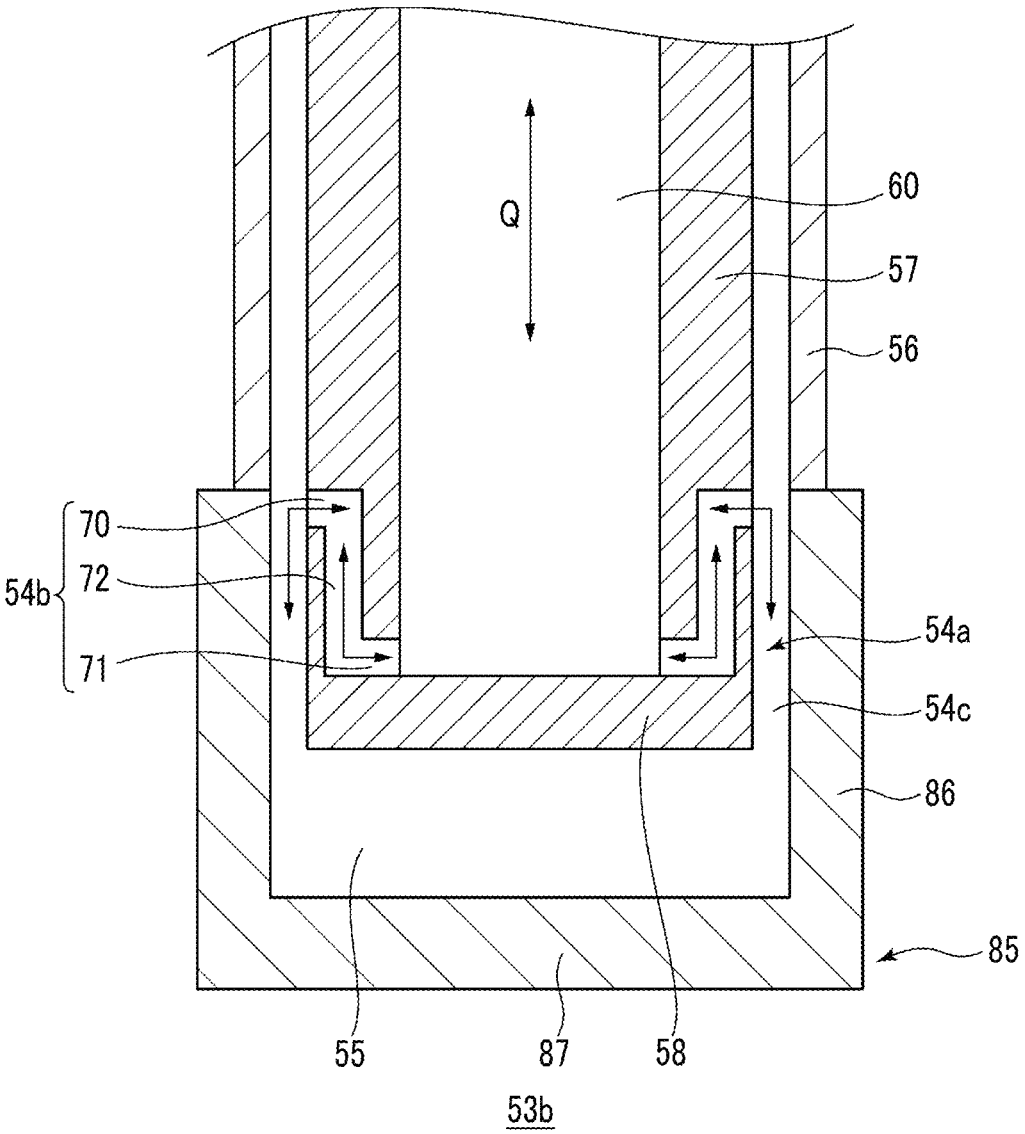
FIG. 2 is a diagram schematically showing a second stage low-temperature end of the regenerative refrigerator according to a certain embodiment of the present invention.

FIG. 2 is a diagram schematically showing the second stage low-temperature end 53*b* of the regenerative refrigerator according to a certain embodiment of the present invention. The second stage displacer gas passage 54*b* has a gap-side opening 70 leading to the second stage gas flow gap 54*c*, and a regenerator-side opening 71 leading to the low-temperature end of the second stage regenerator 60. Accordingly, the gap-side opening 70 is formed in the outer peripheral surface of the second stage displacer side wall 57, and the regenerator-side opening 71 is formed in the inner peripheral surface of the second stage displacer side wall 57. Further, the second stage displacer gas passage 54*b* has a connection path 72 connecting the gap-side opening 70 and the regenerator-side opening 71. The gap-side opening 70 is a gas outlet from the second stage displacer 52 to the outside thereof (and a gas inlet from the displacer outside to the second stage displacer 52), which is provided on the low temperature side of the second stage displacer 52.

The second stage displacer gas passage 54*b* is a bent flow path formed in the second stage displacer side wall 57. The gap-side opening 70 and the regenerator-side opening 71 are formed along a radial direction perpendicular to the axial direction Q, and the connection path 72 is formed along the axial direction Q.

A position of the gap-side opening 70 in an axial direction is further toward the high temperature side than a position of the low-temperature end of the second stage regenerator 60 in the axial direction. That is, the gap-side opening 70 is located further toward the high temperature side with respect to the axial direction Q than the regenerator-side opening 71.

The second stage cooling stage 85 is provided with a second stage cooling stage side portion 86 and a second stage cooling stage bottom portion 87. As shown in FIG. 2, when the second stage displacer 52 is located at the top dead center, the position of the gap-side opening 70 in the axial direction coincides with a position of an end portion on the high temperature side of the second stage cooling stage side portion 86 in the axial direction.

The second stage gas flow gap 54*c* is narrower than the second stage displacer gas passage 54*b*. In such a manner, it is possible to increase the amount of heat exchange between the gas and the second stage cooling stage side portion 86 when the helium gas passes through the second stage gas flow gap 54*c*. Specifically, the width of the second stage gas flow gap 54*c* in the radial direction is smaller than the width of the connection path 72 in the radial direction. Further, the width of the second stage gas flow gap 54*c* may be smaller than the width of the gap-side opening 70 and/or the regenerator-side opening 71 in the axial direction.

As shown in FIG. 1, the GM refrigerator 1 is provided with piping 7 connecting the gas compressor 3 and the cold head 10. In the piping 7, a high-pressure valve 5 and a low-pressure valve 6 are provided. The GM refrigerator 1 is configured such that high-pressure helium gas is supplied from the gas compressor 3 to the first stage cooling section 15 through the high-pressure valve 5 and the piping 7. Further, the GM refrigerator 1 is configured such that low-pressure helium gas is exhausted from the first stage cooling section 15 to the gas compressor 3 through the piping 7 and the low-pressure valve 6.

The GM refrigerator 1 is provided with a driving motor 8 for the reciprocating motion of the first stage displacer 22 and the second stage displacer 52. The first stage displacer 22 and the second stage displacer 52 integrally reciprocate in the axial direction Q by the driving motor 8. Further, the driving motor 8 is connected to the high-pressure valve 5 and the low-pressure valve 6 such that there is selective switching between the opening of the high-pressure valve 5 and the opening of the low-pressure valve 6 in conjunction with the reciprocating motion. In this way, the GM refrigerator 1 is configured so as to appropriately switch between an intake stroke and an exhaust stroke of the working gas.

An operation of the GM refrigerator 1 configured as described above will be described. First, when the first stage displacer 22 and the second stage displacer 52 are respectively located at the bottom dead center or in the vicinity thereof in the first stage cylinder 20 and the second stage cylinder 51, the high-pressure valve 5 is opened. The first stage displacer 22 and the second stage displacer 52 move toward the top dead center from the bottom dead center. During this time, the low-pressure valve 6 remains closed.

The high-pressure helium gas flows from the gas compressor 3 into the first stage cooling section 15. The high-pressure helium gas flows from the first stage high temperature-side gas passages 40*a* into the first stage displacer 22 and is cooled to a predetermined temperature by the first stage regenerator 30. The cooled helium gas flows from the first stage low temperature-side gas flow path 40*b* into the first stage expansion chamber 31. Some of the high-pressure helium gas having flowed into the first stage expansion chamber 31 flows from the second stage high temperature-side gas passage 40*e* into the second stage displacer 52. The helium gas is cooled to a lower predetermined temperature by the second stage regenerator 60 and flows from the second stage low temperature-side gas flow path 54*a* into the second stage expansion chamber 55. As a result, the insides of the first stage expansion chamber 31 and the second stage expansion chamber 55 enter a high pressure state.

If the first stage displacer 22 and the second stage displacer 52 respectively reach the top dead center or the vicinity thereof in the first stage cylinder 20 and the second stage cylinder 51, the high-pressure valve 5 is closed. Approximately at the same time as this, the low-pressure valve 6 is opened. The first stage displacer 22 and the second stage displacer 52 begin to move toward the bottom dead center from the top dead center.

The helium gas in the first stage expansion chamber 31 and the second stage expansion chamber 55 is decompressed, thereby expanding. As a result, the helium gas is cooled. The helium gas cooled in the first stage expansion chamber 31 enters the first stage regenerator 30 through the first stage low temperature-side gas flow path 40*b* (that is, the first stage gas flow gap 40*d* and the first stage displacer gas passage 40*c*). The first stage cooling stage 35 is cooled by the heat exchange between the gas and the first stage cooling stage 35 due to the gas flow in the first stage expansion chamber 31 and the first stage gas flow gap 40*d*. Further, the helium gas cooled in the second stage expansion chamber 55 enters the second stage regenerator 60 through the second stage low temperature-side gas flow path 54*a* (that is, the second stage gas flow gap 54*c* and the second stage displacer gas passage 54*b*). The second stage cooling stage 85 is cooled by the heat exchange between the gas and the second stage cooling stage 85 due to the gas flow in the second stage expansion chamber 55 and the second stage gas flow gap 54*c*. The helium gas cools the first stage regenerator 30 and the second stage regenerator 60 and returns to the gas compressor 3 through the low-pressure valve 6 and the piping 7.

If the first stage displacer 22 and the second stage displacer 52 respectively reach the bottom dead center or the vicinity thereof in the first stage cylinder 20 and the second stage cylinder 51, the low-pressure valve 6 is closed. Approximately at the same time as this, the high-pressure valve 5 is opened again.

In the GM refrigerator 1, the above operation is set as one cycle and the operation is repeated. In this way, the GM refrigerator 1 can absorb heat from an object to be cooled (not shown) thermally connected to each of the first stage cooling stage 35 and the second stage cooling stage 85, thereby cooling the object to be cooled. The temperature of the first stage high-temperature end 23*a* is, for example, room temperature. The temperature of the first stage low-temperature end 23*b* and the second stage high-temperature end 53*a* (that is, the first stage cooling stage 35) is in a range of about 20 K to about 40 K, for example. The temperature of the second stage low-temperature end 53*b* (that is, the second stage cooling stage 85) is, for example, about 4 K.

In this embodiment, the gap-side opening 70 is located further toward the high temperature side than the low-temperature end of the second stage regenerator 60. In other words, the position of a gas coming-in and -out port on the low temperature side of the second stage displacer 52 is provided further toward the high temperature side than an end portion of the second stage regenerator 60. For this reason, a distance from the gap-side opening 70 to the second stage displacer bottom portion 58 in the axial direction is increased, and thus it is possible to lengthen the second stage gas flow gap 54*c* in the axial direction Q. The second stage gas flow gap 54*c* is a gas flow path which causes the gas expanded and cooled in the second stage expansion chamber 55 to flow adjacent to the second stage cooling stage side portion 86 from the second stage expansion chamber 55 to the gap-side opening 70. Since a flow path of the cooled gas is long, the amount of heat exchange between the gas and the second stage cooling stage side portion 86 is increased. Accordingly, it is possible to improve the refrigeration capacity of the GM refrigerator 1.

Figure 3:
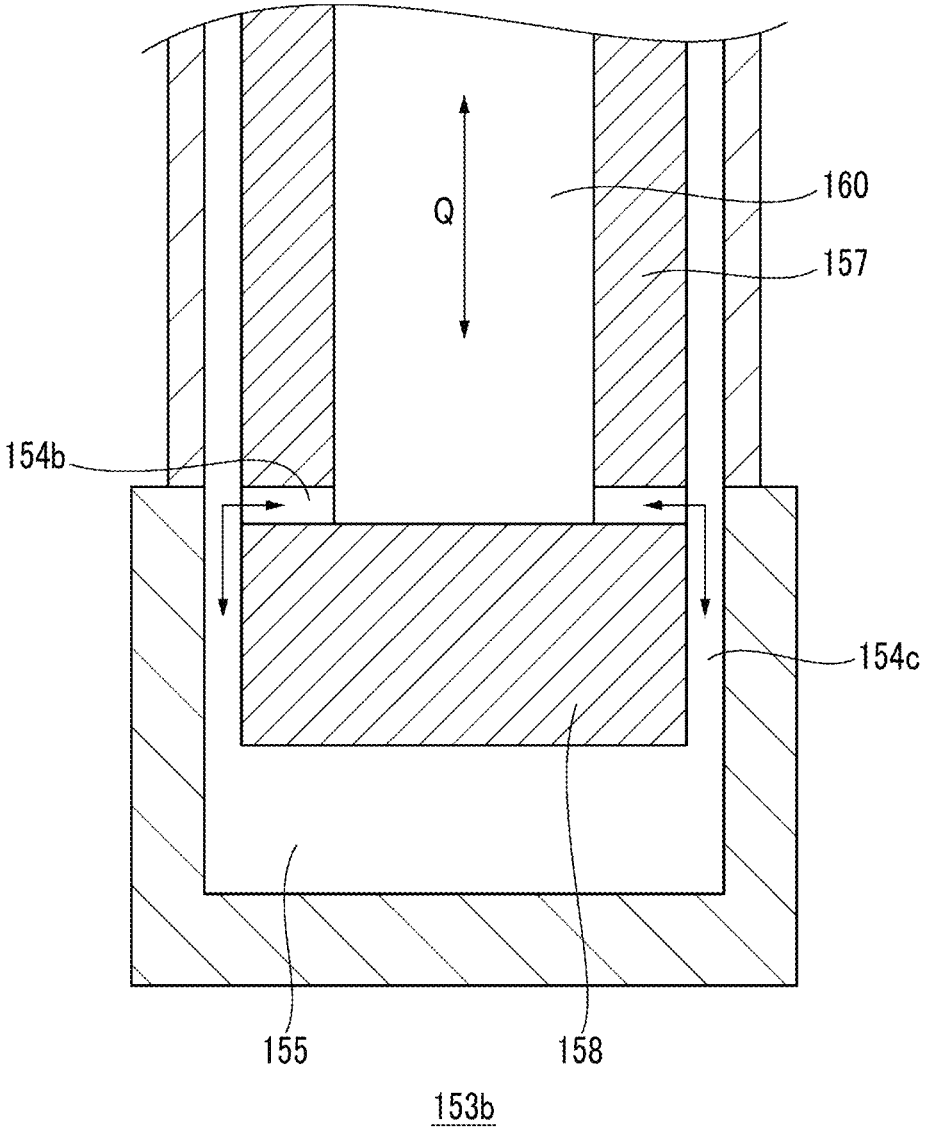
FIG. 3 is a diagram schematically showing a second stage low-temperature end of a certain regenerative refrigerator.

The advantages of the gas flow path configuration related to this embodiment become clear by comparison with a configuration illustrated in FIG. 3. A second stage low-temperature end 153*b* shown in FIG. 3 has a second stage displacer gas passage 154*b* linearly formed in a second stage displacer side wall 157 along the radial direction from a low-temperature end of a second stage regenerator 160, instead of the second stage displacer gas passage 54*b* shown in FIG. 2 in relation to this embodiment. Further, the second stage low-temperature end 153*b* shown in FIG. 3 has a second stage gas flow gap 154*c* having the same length as the second stage gas flow gap 54*c* in the axial direction shown in FIG. 2 in relation to this embodiment. For this reason, the second stage low-temperature end 153*b* has a second stage displacer bottom portion 158 which is significantly thicker in the axial direction Q than the second stage cooling stage bottom portion 87 shown in FIG. 2 in relation to this embodiment. The low-temperature end of the second stage regenerator 160 is separated from a second stage expansion chamber 155.

Therefore, according to this embodiment, since the thickness of the second stage displacer bottom portion 58 in the axial direction is small, it is possible to bring the low-temperature end of the second stage regenerator 60 closer to the second stage expansion chamber 55. A wasteful space occupied by the thick second stage displacer bottom portion 158 as shown in FIG. 3 is not required. It becomes possible to reduce the size of the GM refrigerator 1 by making the length of the second stage cooling section 50 in the axial direction short.

Changing a viewpoint, in this embodiment, the regenerator-side opening 71 is disposed further toward the low temperature side than the gap-side opening 70, and therefore, it is possible to make the second stage regenerator 60 related to this embodiment longer in the axial direction than the second stage regenerator 160 shown in FIG. 3. Accordingly, since it is possible to increase the amount of regenerative material of the second stage regenerator 60, it is possible to improve the refrigeration capacity of the GM refrigerator 1.

The present invention has been described above based on an embodiment. The present invention is not limited to the above-described embodiment and various design changes are possible, and it is to be understood by those skilled in the art that various modified examples are possible and such modified examples are also in the scope of the present invention.

Figure 4:
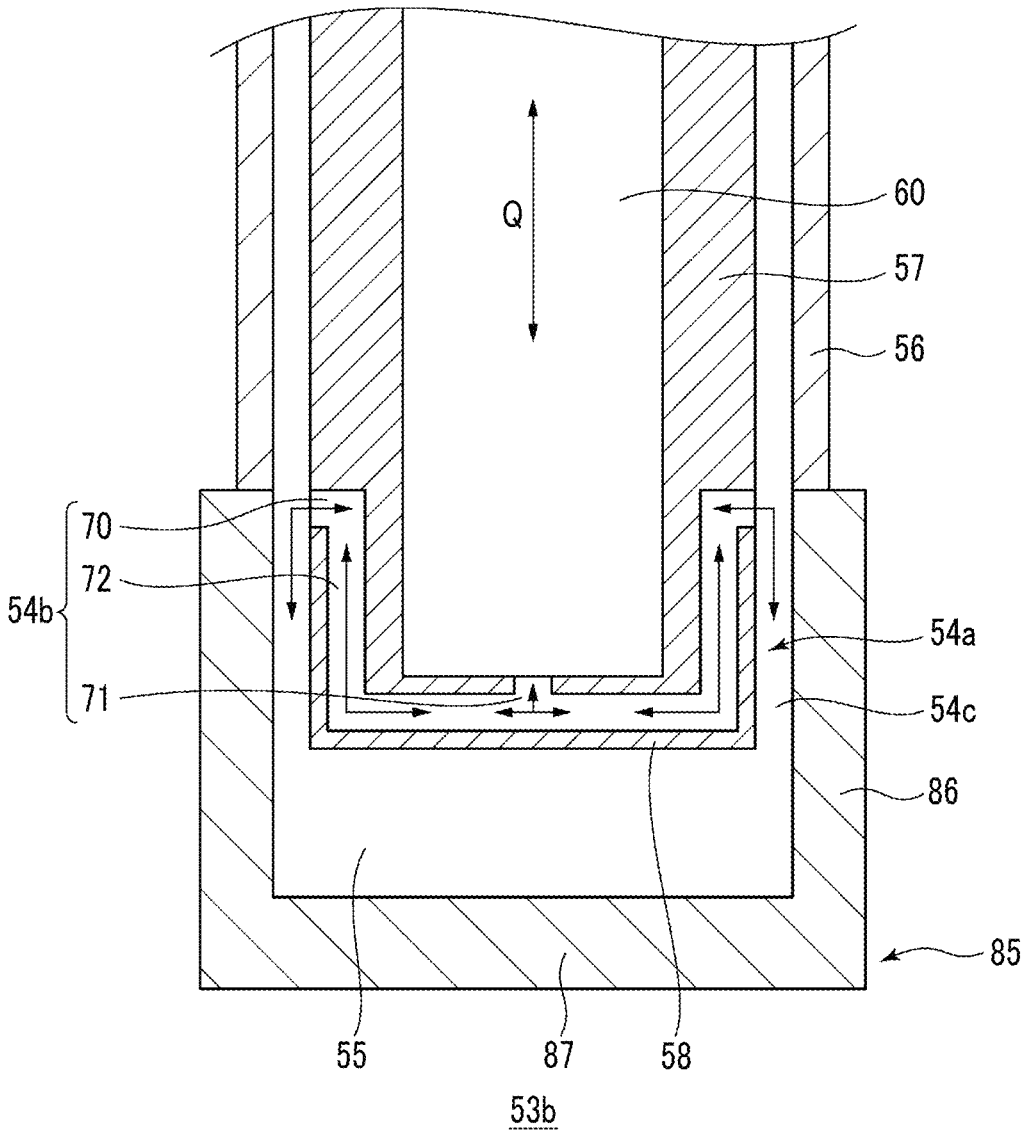
FIG. 4 is a diagram schematically showing a second stage low-temperature end of a regenerative refrigerator according to another embodiment of the present invention.

For example, as shown in FIG. 4, the regenerator-side opening 71 of the second stage displacer gas passage 54*b* may be formed in the second stage displacer bottom portion 58. The gap-side opening 70 is formed in the outer peripheral surface of the second stage displacer side wall 57, similar to the embodiment described above. In this way, the gap-side opening 70 may be disposed further toward the high temperature side with respect to the axial direction Q than the regenerator-side opening 71.

Figure 5:
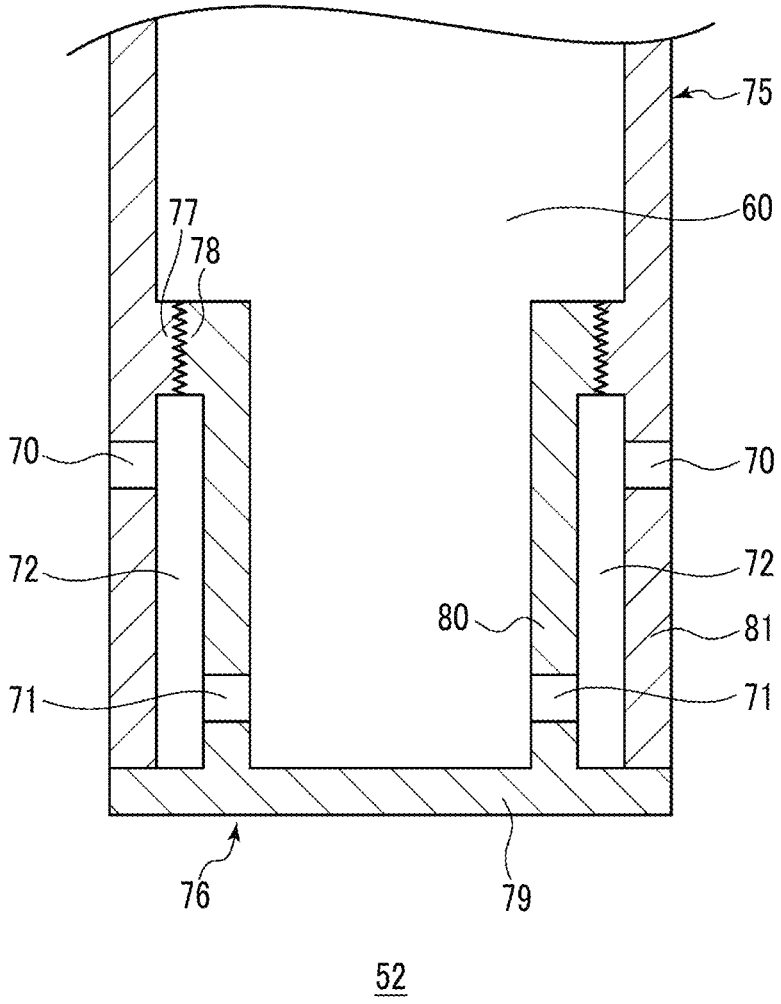
FIG. 5 is a diagram schematically showing the low temperature side of a second stage displacer of a regenerative refrigerator according to still another embodiment of the present invention.

Alternatively, as shown in FIG. 5, the second stage displacer 52 may be provided with a displacer main body portion 75 having the gap-side opening 70, and a displacer lid portion 76 having the regenerator-side opening 71. A configuration may be made in which the displacer main body portion 75 is provided with a main body threaded portion 77 and the displacer lid portion 76 is provided with a lid threaded portion 78. According to such a configuration, it is easy to realize the bent gas flow path configuration related to this embodiment in a displacer low-temperature end.

A low-temperature end of the displacer main body portion 75 is open, and from the opening portion, the displacer lid portion 76 is inserted into the low-temperature end of the displacer main body portion 75, and the lid threaded portion 78 is screwed to the main body threaded portion 77. In this way, the displacer lid portion 76 is fixed to the displacer main body portion 75.

The displacer lid portion 76 is provided with a displacer bottom portion 79 which blocks the low-temperature end of the displacer main body portion 75, and an inner wall portion 80 which extends from the displacer bottom portion 79 to the high temperature side so as to be inserted into the low-temperature end of the displacer main body portion 75. The regenerator-side opening 71 is provided in a low-temperature end of the inner wall portion 80. The lid threaded portion 78 is provided at an end portion on the high temperature side of the inner wall portion 80. A plurality of regenerator-side openings 71 may be formed along a circumferential direction.

The displacer main body portion 75 is provided with an outer wall portion 81 which surrounds the inner wall portion 80 of the displacer lid portion 76. The gap-side opening 70 is provided in the outer wall portion 81 so as to be located further toward the high temperature side with respect to the axial direction Q than the regenerator-side opening 71. A plurality of gap-side openings 70 may be formed along the circumferential direction. A low-temperature end of the outer wall portion 81 comes into contact with an outer peripheral portion of the displacer bottom portion 79. The main body threaded portion 77 is provided somewhat further toward the high temperature side than the gap-side opening 70. The connection path 72 is formed between the inner wall portion 80 and the outer wall portion 81.

In addition, contrary to the embodiment shown in FIG. 5, a configuration may be made in which the displacer main body portion 75 is provided with an inner wall portion having the regenerator-side opening 71 and the displacer lid portion 76 is provided with an outer wall portion having the gap-side opening 70. In this case, a configuration may be made in which the low-temperature end of the displacer main body portion 75 is covered with the displacer lid portion 76, the lid threaded portion 78 is screwed to the main body threaded portion 77, and thus the displacer lid portion 76 is fixed to the displacer main body portion 75.

In the embodiments described above, the second stage of the regenerative refrigerator of a two-stage type has been described as an example. However, certain embodiments of the present invention are not limited thereto. For example, the gas flow path configuration related to a certain embodiment may be provided in a low-temperature end of the first stage (for example, the first stage low-temperature end 23*b*) of the regenerative refrigerator of the two-stage type. In this case, the first stage displacer gas passage 40*c* may be formed as a bent flow path formed in the first stage displacer side wall 24 and/or a first stage displacer bottom portion. For example, a configuration may be made in which a gap-side opening and a regenerator-side opening of the first stage displacer gas passage 40*c* are formed in the first stage displacer side wall 24 along the radial direction and a connection path of the first stage displacer gas passage 40*c* is formed in the first stage displacer side wall 24 along the axial direction Q. A position of the gap-side opening in the axial direction is further toward the high temperature side than a position of the low-temperature end of the first stage regenerator 30 in the axial direction. The gap-side opening is located further toward the high temperature side with respect to the axial direction Q than the regenerator-side opening. The gas flow path configuration related to a certain embodiment may be provided in low-temperature ends of both the first stage and the second stage.

Alternatively, the gas flow path configuration related to a certain embodiment may be provided in a low-temperature end of a regenerative refrigerator of a single stage type. Furthermore, the gas flow path configuration related to a certain embodiment may be provided in a low-temperature end of at least one stage of a regenerative refrigerator of a three-stage type (or another multi-stage type).

In the embodiments described above, the GM refrigerator 1 has been described as an example. However, there is no limitation thereto, and the gas flow path configuration related to a certain embodiment may be provided in other types of regenerative refrigerator which are provided with a displacer having a built-in regenerator.

The GM refrigerator 1 or other regenerative refrigerators having the gas flow path configuration related to a certain embodiment may be used as cooling means and liquefaction means in a superconducting magnet, a cryopump, an X-ray detector, an infrared sensor, a quantum photon detector, a semiconductor detector, a dilution refrigerator, a He3 refrigerator, an adiabatic demagnetization refrigerator, a helium liquefier, a cryostat, or the like.

It should be understood that the invention is not limited to the above-described embodiment, but may be modified into various forms on the basis of the spirit of the invention. Additionally, the modifications are included in the scope of the invention.

What is claimed is:

1. A regenerative refrigerator of a single stage type or a multistage type comprising:

a cylinder which is provided with a cooling stage;

a displacer which is provided with a regenerator provided at the same stage as the cooling stage and disposed so as to be able to move in an axial direction in the cylinder; and a low temperature-side gas flow path which makes a gas expansion space between the displacer and the cooling stage communicate with a low-temperature end of the regenerator, wherein the cylinder is provided with a cylinder side wall extending in the axial direction from the cooling stage to a high temperature side, the displacer is provided with a displacer side wall extending to face the cylinder side wall in the axial direction, the low temperature-side gas flow path is provided with a gas flow gap defined by an outer peripheral surface of the displacer side wall and an inner peripheral surface of the cylinder side wall, and a displacer gas passage which permits a flow of gas between the gas flow gap and the low-temperature end of the regenerator, the gas flow gap is continuous to the gas expansion space on a low temperature side in the axial direction, the displacer gas passage is provided in the displacer side wall and has a gap-side opening leading to the gas flow gap in the outer peripheral surface of the displacer side wall, a regenerator-side opening leading to the low temperature end of the regenerator in an inner peripheral surface of the displacer side wall, and a connection path connecting the gap-side opening and the regenerator-side opening, and in the axial direction, the gap-side opening is closer to the high temperature side than the regenerator-side opening.

2. The regenerative refrigerator according to claim 1, wherein the gas flow gap is narrower than the displacer gas passage.

3. The regenerative refrigerator according to claim 1, wherein the regenerative refrigerator of the multistage type is a regenerative refrigerator of a two-stage type which is provided with a first stage which is a high temperature stage, and a second stage which is a low temperature stage, and the displacer gas passage is provided in the second stage.

4. The regenerative refrigerator according to claim 1, wherein the displacer is provided with a main body portion having the gap-side opening, and a lid portion having the regenerator-side opening, the main body portion is provided with a main body threaded portion, and the lid portion is provided with a lid threaded portion which is screwed to the main body threaded portion.

5. The regenerative refrigerator according to claim 1, wherein the connection path is in the axial direction.

6. A regenerative refrigerator of a single stage type or a multistage type comprising:

a cylinder which is provided with a cooling stage;

a displacer which is provided with a regenerator provided at the same stage as the cooling stage and disposed so as to be able to move in an axial direction in the cylinder; and a low temperature-side gas flow path which makes a gas expansion space between the displacer and the cooling stage communicate with a low-temperature end of the regenerator, wherein the cylinder is provided with a cylinder side wall extending in the axial direction from the cooling stage to a high temperature side, the displacer is provided with a displacer side wall extending to face the cylinder side wall in the axial direction, the low temperature-side gas flow path is provided with a gas flow gap defined by an outer peripheral surface of the displacer side wall and an inner peripheral surface of the cylinder side wall, and a displacer gas passage which makes the gas flow gap communicate with the low-temperature end of the regenerator, the gas flow gap is continuous to the gas expansion space on a low temperature side in the axial direction, the displacer gas passage has a gap-side opening leading to the gas flow gap in the outer peripheral surface of the displacer side wall, and a position of the gap-side opening in the axial direction is further toward the high temperature side than a position of the low-temperature end of the regenerator in the axial direction, wherein the displacer gas passage has a regenerator-side opening leading to the low-temperature end of the regenerator, the displacer is provided with a main body portion having the gap-side opening, and a lid portion having the regenerator-side opening, the main body portion is provided with a main body threaded portion, and the lid portion is provided with a lid threaded portion which is screwed to the main body threaded portion.

* * * * *